US008826899B2

(12) United States Patent
Riemens et al.

(10) Patent No.: US 8,826,899 B2
(45) Date of Patent: Sep. 9, 2014

(54) WOOD PELLET STOVE FOR POWER OUTPUTS OF DOWN TO LESS THAN 1 KW

(75) Inventors: André Riemens, Urdorf (CH); Gabriela Vetsch, Urdorf (CH); Basso Salerno, Langenbruck (CH)

(73) Assignee: STUV S.A., Bois de Villers (BE)

( * ) Notice: Subject to any disclaimer, the term of this patent is extended or adjusted under 35 U.S.C. 154(b) by 373 days.

(21) Appl. No.: 13/390,624

(22) PCT Filed: Aug. 12, 2010

(86) PCT No.: PCT/CH2010/000197

§ 371 (c)(1),
(2), (4) Date: Apr. 26, 2012

(87) PCT Pub. No.: WO2011/020202

PCT Pub. Date: Feb. 24, 2011

(65) Prior Publication Data

US 2012/0199107 A1 Aug. 9, 2012

(30) Foreign Application Priority Data

Aug. 19, 2009 (CH) ..... 1288/09

(51) Int. Cl.

| | |
|---|---|
| ***F24C 1/00*** | (2006.01) |
| ***F23B 40/04*** | (2006.01) |
| ***F23K 3/14*** | (2006.01) |

(52) U.S. Cl.

CPC .. *F23K 3/14* (2013.01); *F23B 40/04* (2013.01)

USPC ..... 126/58; 126/68; 126/73; 126/107; 126/7; 126/10; 110/267; 110/293

(58) Field of Classification Search

USPC ..... 126/58, 68, 73, 107, 7, 10, 501; 110/255, 257, 293, 267

See application file for complete search history.

(56) References Cited

U.S. PATENT DOCUMENTS 2,371,191 A * 3/1945 Sherman ..... 110/230

FOREIGN PATENT DOCUMENTS

| | | |
|---|---|---|
| AT | 410364 B | 4/2003 |
| GB | 520421 | 4/1940 |
| JP | 60-117003 A | 6/1985 |

* cited by examiner

*Primary Examiner* — Alfred Basichas

(74) *Attorney, Agent, or Firm* — Reinhart Boerner Van Deuren P.C.

(57) ABSTRACT

The invention relates to a wood pellet stove, comprising a feed device for automatically adding wood pellets in a metered manner from a pellet hopper belonging to the stove. Said pellet hopper having the feed device and a grate is accommodated in a lower, stationary stove part (20), which remains cold and does not become hot during operation. The combustion chamber having a chimney connection is accommodated in an upper stove part (21). The upper stove part (21) is supported on the lower stove part (20) by means of a turntable so that the upper stove part can be swiveled relative to the lower, stationary stove part (20). Thus, the combustion chamber and the viewing window can be swiveled in any desired direction as needed.

12 Claims, 9 Drawing Sheets

WOOD PELLET STOVE FOR POWER OUTPUTS OF DOWN TO LESS THAN 1 KW

The burning of finely portioned and therefore granular fuel, for example wood pellets, wood chips, small pieces of wood or even dried corn, proves to be favourable from an energy point of view and practical in terms of handling. There is no need to transport and store large and cumbersome pieces of wood and also there is no need to feed the fire with large logs. The measuring of combustion power outputs down to a low value is nowadays made possible by a special fuel feed device for granular fuel. This makes it possible to ensure power outputs of down to less than 1 kW. This process is carried out using a conveyor screw which is arranged in a pipe and is intended for conveying and adding the granular fuel. The central screw spindle pipe of the conveyor screw, on the outer wall of which the screw winding is fitted and together with which the conveyor screw is rotatably mounted in the pipe, takes up at least one-quarter of the pipe diameter. This screw spindle pipe runs out at the top as a cone into a tip. Located above the screw is a circular grate having a central round hole and air supply openings in the outer region of the grate. The hole is somewhat smaller than the diameter of the conveyor screw, and a wall which widens in a conical manner runs downwards from the edge thereof as a sliding wall for the fuel to be conveyed, said wall running approximately or exactly parallel to the cone of the upper end of the screw spindle. With such a conveyor device or a similar conveyor device, a wood pellet stove can be operated largely automatically, and even at very low power outputs of less than 1 kW it is ensured that the fire does not go out. Moreover, the ashes are transported away and the fire is prevented from eating into the feed stream of the fuel.

Such a wood pellet stove is therefore an efficient means of heating and it is preferably set up in the living room. Here, however, it should also satisfy further technical requirements. Wood pellet stoves known to date must always be set up in a free-standing manner, that is to say that, even if they are set up in front of a wall, a prescribed distance from the back wall must be left for fire safety reasons. However, this is a technical restriction which often has an unsightly effect. Furthermore, with a wood pellet stove, the desire is not only to achieve a heat output but also to exude an air of cosiness and to blend in harmoniously with the surrounding furniture. Added to this is the fact that in many living rooms there is often a seating area in addition to the dining area. There is a desire to be able to see the fire from both areas. However, this is not possible with the existing wood pellet stove constructions. The fire is visible only within a limited viewing angle. The direct heat emission from the fire is just as unable to be directed towards the current whereabouts of the inhabitant.

The object of the present invention is therefore to provide a wood pellet stove which has a burning chamber with an open side that can be oriented in different directions, and which can be connected to a back wall without any gaps.

This object is achieved by a wood pellet stove comprising a feed device for automatically adding wood pellets from a pellet hopper belonging to the stove, characterised in that the pellet hopper with the feed device are accommodated in a stationary lower part, which remains cold during operation, and the burning chamber with the flue connection are accommodated in an upper stove part, wherein the upper stove part is mounted on the lower stove part by means of a turntable so that it can swivel relative to the lower, stationary stove part.

This wood pellet stove will be presented and described in more detail below with reference to the drawings, and its structure and function will be explained.

Figure 1:
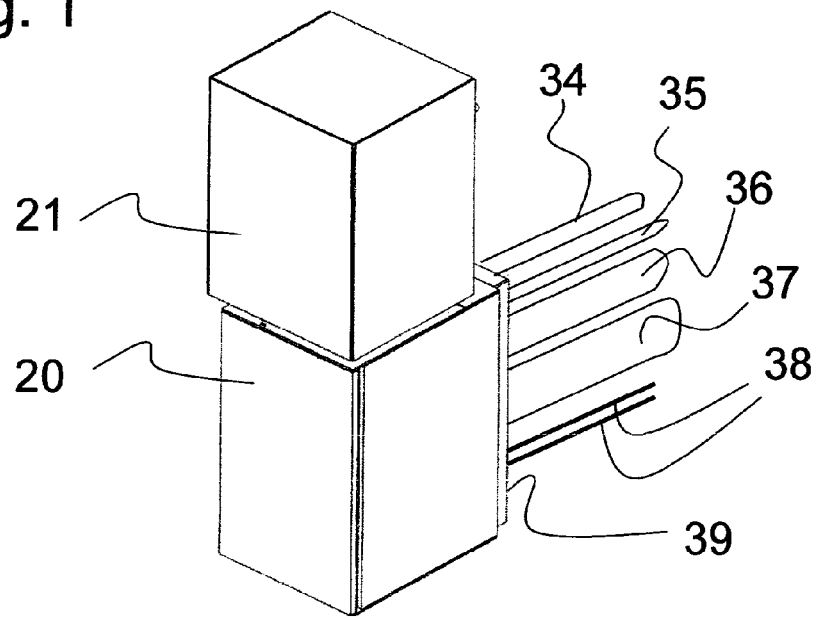
FIG. 1 shows the wood pellet stove consisting of the lower part with the connections and the upper part placed thereon.

FIG. 1 shows the wood pellet stove in an overall view. It consists of a lower part 20 and an upper part 21 placed thereon in a swivellable manner. The front side of the upper part 21 is made of heat-resistant glass and provides a view into the burning space, which is nevertheless not shown here. The lower part 20 contains the hopper for the wood pellets and the feed device for the metered feeding of wood pellets onto the grate. The lower part 20 remains cold during operation and is designed here as an orthorhombic body. All of the connections 34-38 are connected to the stove on the rear side of the lower part 20, namely the pipe 36 for the fresh air supply, the pipe for discharging the flue gases 37, the electrical connections 38 for operating the pellet conveyor and the fan for conveying the feed air and optionally for discharging the flue gases, and possible water connections 34, 35 for a circuit in the casing of the burning chamber for absorbing and discharging heat to a central heating system. In a further design, an additional pipe which opens on the rear side may be provided for supplying pellets, so that these pellets can then be filled from a separate chamber into the reservoir inside the lower part 20 of the stove, which otherwise takes place from the front by removing the front cover on the lower part 20. Arranged around the lower part 20, along the rear edge thereof, is a bezel 39 which forms a neat connection to the back wall against which the stove is placed at a distance. This bezel 39 is formed by a sheet metal strip which is bent into a U-shape, so that the bezel 39 can be placed from above onto the rear side of the lower, cold stove part 20. Previously, a free-standing stove always had to be installed at a prescribed distance from the wall, in front of the latter, for fire safety reasons since it is indeed hot. In the case of this stove here, however, the lower part 20 remains cold and can therefore readily be neatly connected to the back wall by means of a bezel 39, so that there is no annoying gap between the stove and the back wall, which is much tidier from an aesthetic point of view.

Figure 2:
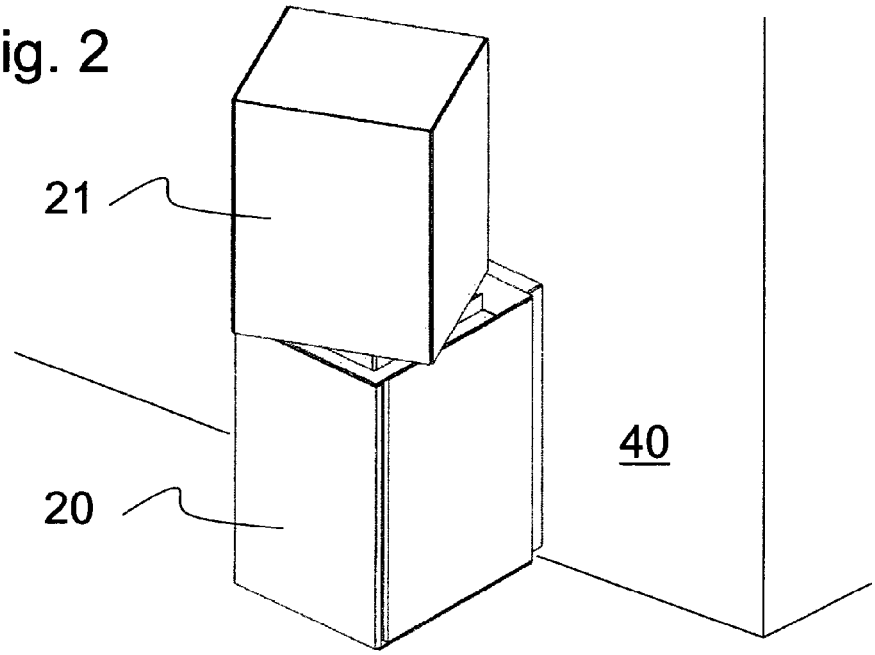
FIG. 2 shows the wood pellet stove consisting of the lower part and the upper part mounted swivellably thereon, set up in front of a back wall.

In FIG. 2, the stove is shown installed in front of a back wall 40. As a special feature, the upper part 21 of this wood pellet stove is able to swivel with respect to the lower part 20 and here, as seen from above, is swivelled through approx. 20° in the anticlockwise direction with respect to the lower part 20. The lower part 21 of the stove forms a neat connection to the back wall 40 by way of a bezel 39 which closes the gap between the lower part 20 and the back wall 40. The swivelling range of the upper part 21 on the lower part 20 is approx. ±25°, that is to say approx. 50° in total, but depending on the configuration of the interposed turntable may also be a full 180°, so that the upper part 21, with its glass front side which provides a view of the burning chamber, can be directed fully to the left or fully to the right.

Figure 3:
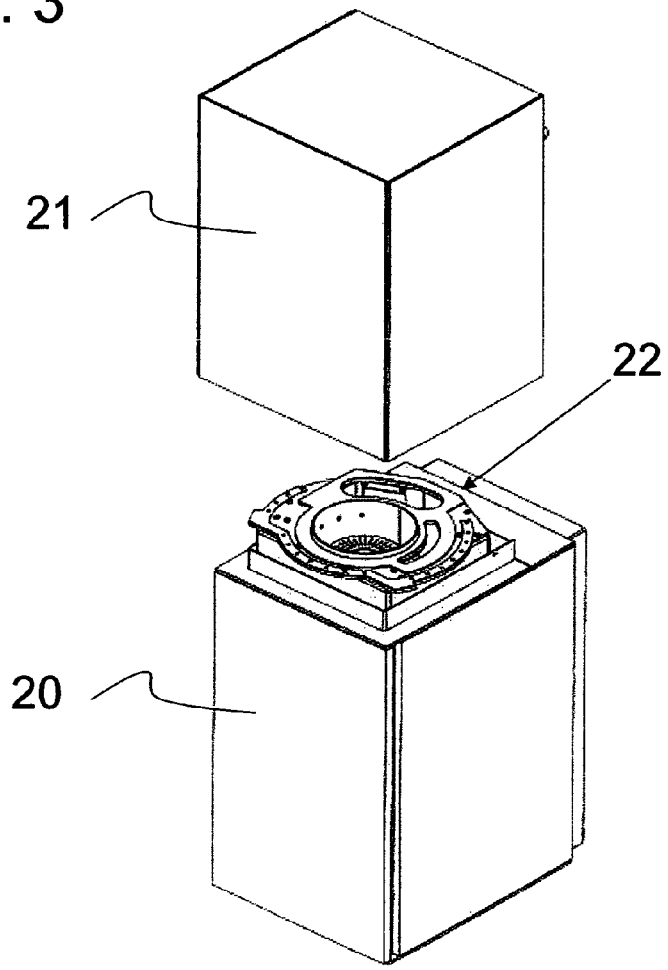
FIG. 3 shows the wood pellet stove with the lower part and the upper part lifted away from the latter, with the turntable for the swivellable mounting of the upper part.
Figure 4:
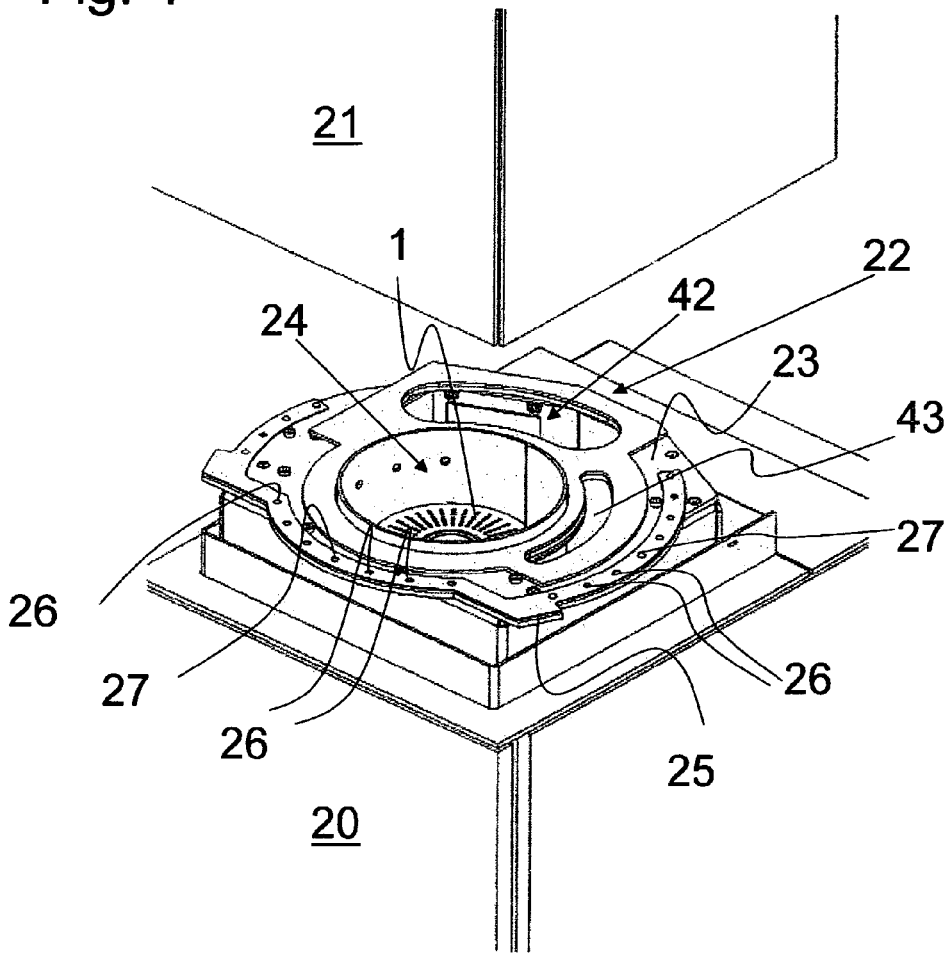
FIG. 4 shows the turntable according to FIG. 3 in an enlarged view.

FIG. 3 shows this wood pellet stove with the lower part 20 and the upper part 21 lifted away from the latter, revealing the turntable 22 for the swivellable mounting of the upper part 21. This turntable 22 is built onto the top of the lower part 20 and its structure will be described in more detail on the basis of FIG. 4. It consists of a bottom disc 23 having a central hole 24, and an intermediate disc 25 likewise having a central hole 24, which is swivellable about the latter. This intermediate disc 25 has holes 26 arranged around the periphery, in each of which a ball 27 is trapped. Finally, a top disc 28, which surrounds the central hole 24 in the manner of a ring around a large portion of the circumference, rests on said balls 27 so that it can swivel around the central hole 24 by rolling on the balls 27. The balls 27 roll inside the holes 26 of the intermediate disc 25 in which they are trapped, and thus roll on the bottom disc 23. The intermediate disc 25 swivels with the balls 27 rolling in the holes thereof, namely always by half the degree of swivelling of the top disc 28. This ball-mounted swivellability of the upper part 21 of the wood pellet stove on its lower part 20 ensures a low-friction running and the balls 27 carry the load of the stove upper part 21, which is mounted on the top disc 28. The turntable 22 leaves clear a curved elongate hole 42, through which the flue gas line 37 and if necessary the lines 34, 35 for the water circuit are passed, and the hole 42 is large enough that it can be swivelled with the turntable around these stationary lines. Another such elongate hole 43 serves for receiving the fresh air line. Located at the bottom in the hole 24 is the actual grate 1 to which the wood pellets are automatically fed, as will be demonstrated below.

Figure 5:
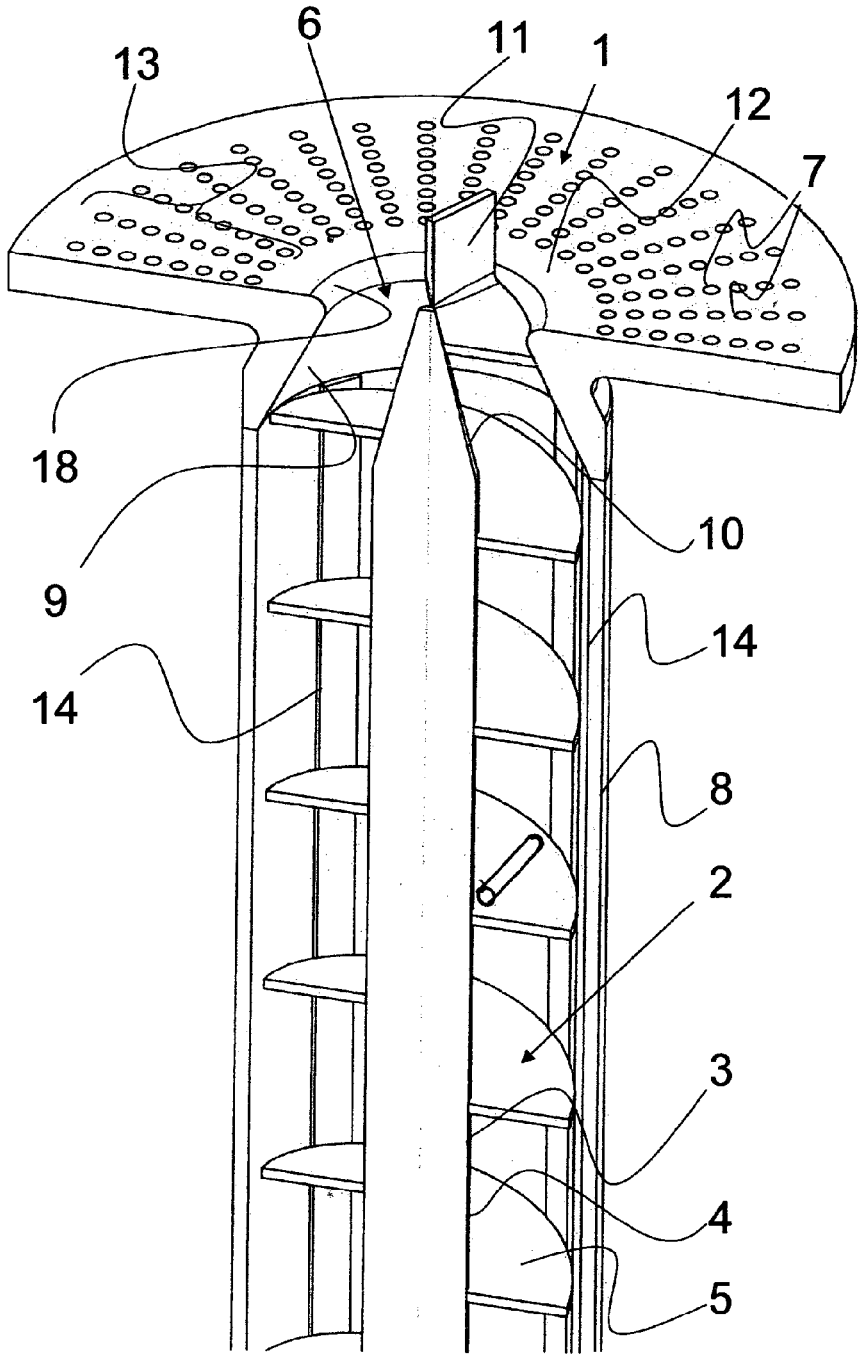
FIG. 5 shows the feed device with the grate arranged at the upper end thereof, as seen in longitudinal section.

This feed device is shown in longitudinal section in FIG. 5 with the grate 1 arranged at the upper end, and is intended for granular fuel for a stove designed for power outputs of down to less than 1 kW. The fuel may consist of wood pellets, but also wood chips, small pieces of wood or even dried corn or other grains. The grate 1 of the stove cooperates with the feed device, and the latter is equipped with a conveyor screw 2. In the illustrated example, the conveyor screw 2 is arranged perpendicular to the grate surface, and the central screw spindle pipe 3, on the outer wall 4 of which the screw winding 5 is fitted and together with which the conveyor screw 2 is rotatably mounted in the conveyor pipe 8, takes up a considerable part of the conveyor pipe 8, which encloses the entire conveyor screw 2. The conveyor pipe 8 with the conveyor screw 2 may also be arranged at an oblique angle to the perpendicular. Additional friction of the fuel with the conveyor pipe 8 is then achieved on the underside, which is beneficial to the conveying process. In the illustrated example, the pipe diameter of the screw spindle pipe 3 measures one-third of the conveyor screw diameter or of the conveyor pipe diameter, and the latter measures for example 60 mm. The diameter of the screw spindle pipe 3 should be at least one-quarter of the conveyor screw diameter, since a sufficient torque can thus also be transmitted to the actual screw 2 or to the conveying surface 5 which is as smooth as possible and is wound in a helical manner around the screw spindle pipe 3. Shown here on the conveying surface 5 of the screw 2 is one single wood pellet 18 in order to provide an approximate size comparison. This screw spindle pipe 3 runs out at the top as a cone 10 into a tip, wherein arranged horizontally above the screw 2 is the grate 1 having a central round hole 6. It fits precisely onto the upper end of the conveyor screw spindle pipe 8 and is placed onto the latter.

The grate 1 is preferably circular as shown and is penetrated by air supply openings 7 in the outer region. The circular hole 6 in the grate 1 measures approximately one-half of the conveyor pipe diameter. This circular hole 6 is adjoined by a downwardly projecting, funnel-shaped edge 9, wherein the latter opens downwards as a funnel. The funnel wall runs almost or exactly parallel to the cone 10 on the screw spindle pipe 3. In the illustrated example, the cone 10 encloses an acute angle with the direction in which the funnel inner wall runs, the tip of the angle being located at the top. This angle should be only very small, since otherwise the fuel would become jammed in the region between the cone 10 and the funnel inner wall. The actual screw 2 or the wound conveying surface 5 thereof ends with an extension 11 running approximately perpendicular to the grate surface. The outer side of the extension, with respect to the axis of rotation, ends flush with the inner edge of the hole 6. This conveyor screw 2, as shown here, rotates in the clockwise direction during operation, as seen from above. Of course, it could also be constructed in such a way as to convey in the anticlockwise direction. The fuel to be conveyed remains approximately at the same point in relation to its rotary position in the conveyor pipe 8, and the conveying surface 5 of the screw 2 slides through below the fuel, lifting it upwards in the conveyor pipe 8 until it finally reaches the level of the hole 6. For reliable conveying of the fuel by the conveyor screw, it has also proven to be important that the inner side of the pipe 8 is provided with a plurality of plateaus or grooves 14 which preferably run axially and past which the screw winding rotates at a minimal distance, and leaves clear between the plateaus or grooves a distance from the height of the plateaus or grooves to the inner wall of the pipe 8. For the same purpose, the inner wall of the pipe 8 may also be provided with a rough surface.

Nevertheless, the conveyor screw 2 rotates only very slowly, at a speed of revolution of less than 1 rpm. Once it has arrived at the top, the fuel is caught by the extension 11 and, as seen from above, is pushed around in the clockwise direction. At the location where the extension almost touches the edge of the hole 6, its absolute speed is only approx. 1.5-2.0 mm/s. However, this slow rotation of the extension 11 ensures that the portions of fuel which have been pushed along migrate radially outwards due to the acting forces and finally are pushed onto the region 12 of the grate surface 1. This region, a concentric ring which adjoins the hole 6 in the grate 1, is free of ventilation holes 7. Accordingly, the portions of fuel burn with difficulty there and must first be pushed further radially outwards. This takes place during the next pass of the extension 11, when the latter again pushes portions of fuel a little way onto the grate surface. In this way, the portions of fuel are pushed very slowly minute by minute, with each pass of the extension 11, onto the grate and finally onto the burning zone thereof, which is formed by the region 13 equipped with air holes 7. The diameter of the grate 1 as a whole is approximately twice the diameter of the conveyor pipe 8. Therefore, if the latter measures 60 mm, the grate 1 has a diameter of approx. 120 mm. Due to the gentle and continuous feeding of fresh fuel, a beautiful, high and regular flame pattern is achieved on the grate 1, rather than flickering, technically acting flames.

Figure 6:
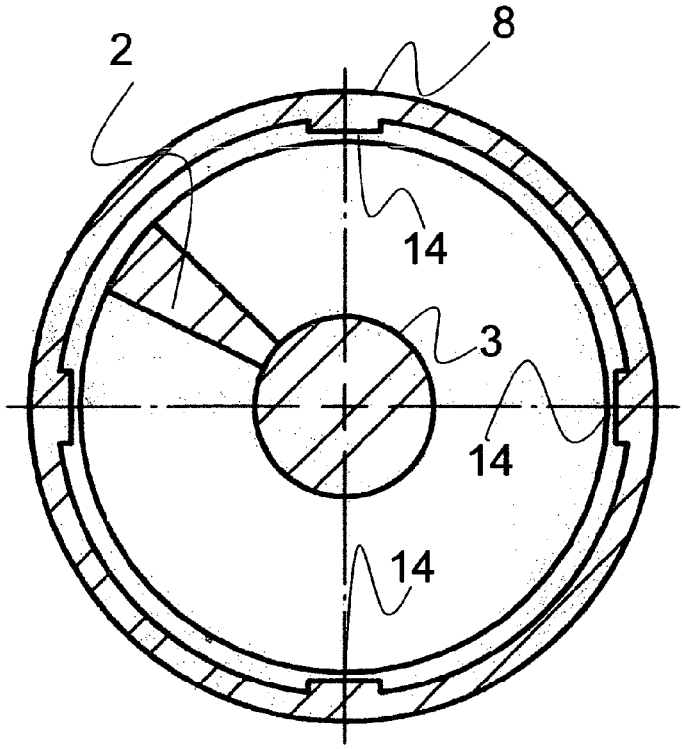
FIG. 6 shows a cross section through the conveyor screw, as seen from above.

In FIG. 6, the conveyor screw and the conveyor pipe 8 are shown in cross section. It is possible to see here the grooves or projections 14 on the inner side of the conveyor pipe 8, as well as a segment of the actual screw 2 which moves with its outer edge just past these projections 14. The portions of fuel are held back at these projections or grooves, which helps to prevent them from rotating with the conveyor screw 2. The rotation of the conveyor screw 2, which slides through below the fuel, does indeed cause a force component that points radially outwards. Accordingly, the fuel is pressed against the inner wall of the conveyor pipe 8 and is held back at the projections. When the outermost portions of fuel are held there, these hold back the inwardly adjacent portions and the latter hold back the next inwardly adjacent, etc., so that a co-rotation of the pieces of fuel is effectively avoided regardless of whether the fuel consists of wood pellets, of wood chips, of small pieces of wood or of dried grains of corn or the like.

Figure 7:
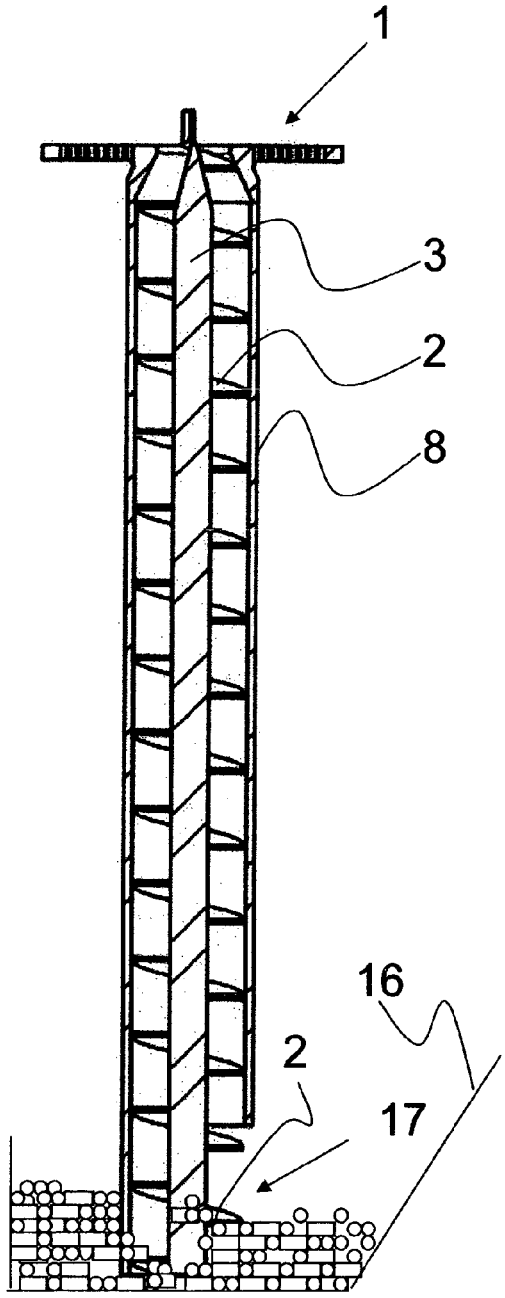
FIG. 7 shows the entire conveyor screw as seen from the side, shown in longitudinal section.

FIG. 7 shows the conveyor screw 2 along its entire height. It measures between 200 mm and 800 mm in height and between 55 mm and 85 mm in diameter. The conveyor screw spindle pipe 3 measures in terms of diameter one-quarter to somewhat more than one-third of the diameter, and the pitch of the screw winding per revolution is approx. one-half of the conveyor screw diameter. At the bottom, the conveyor pipe 8 can stand completely in a heap of fuel portions, or in a box 15 which can be loaded with fuel from above or via, for example, an inclined surface 16 as a feed chute. At the bottom, the conveyor pipe 8 is open on one side and the pieces of fuel, cylindrical wood pellets in the illustrated example, trickle through this opening 17 in the conveyor pipe 8 onto the screw 2.

The fuel feed device for such wood stoves for power outputs of less than 1 kW is fitted with an electric motor which drives the screw 2 via a reduction gear unit. Depending on the voltage-dependent actuation of the electric motor, the speed of revolution of the conveyor screw 2 can be adjusted from 0.5 to 2 revolutions per minute, and hence the feed quantity of fuel per unit time and thus the heating power output can be controlled.

Figure 8:
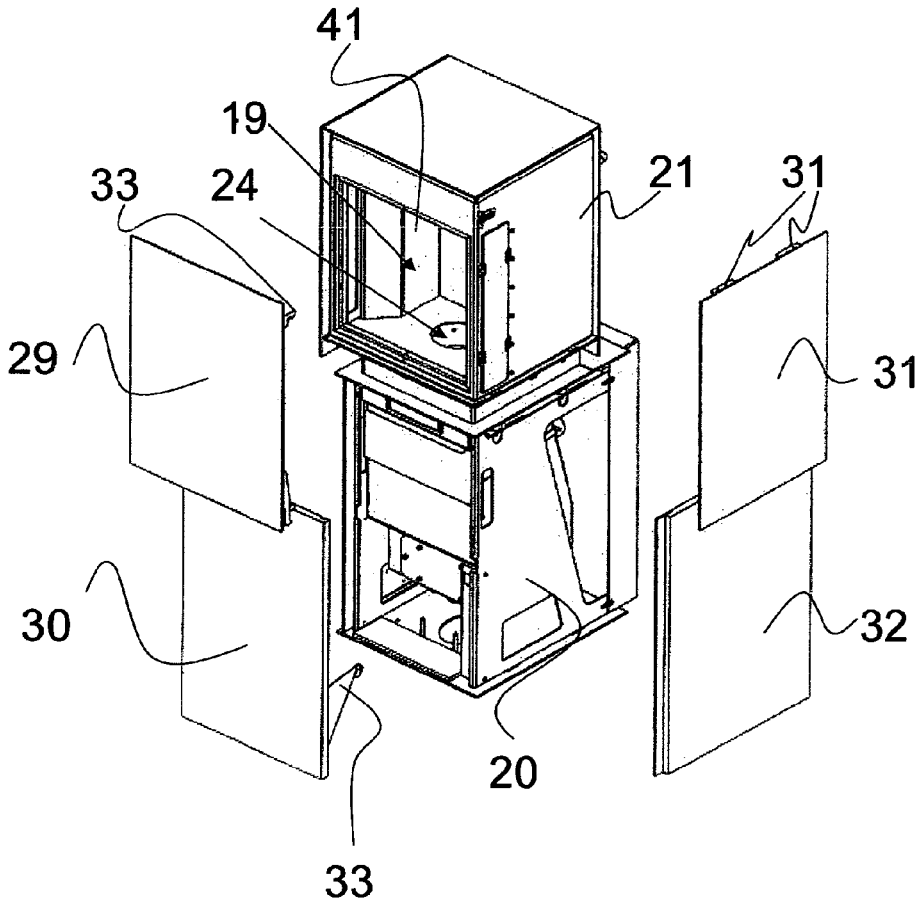
FIG. 8 shows the lower part and upper part of the stove with dismantled lining parts.

FIG. 8 shows the lower part and upper part of the stove with the lining parts 29-32 dismantled. The stove is constructed in such a way that it can be assembled on site without the aid of tools. Only the internal structure of the lower part 20 and upper part 21 is ready-assembled in the factory, wherein, wherever possible, plug-in, hook-on and push-in connections are also created here in order to manage without screws as far as possible. On its sides and rear, the burning chamber 19 is comprised of fire bricks or of a sheet metal hollow body 41. The heat generated can thus be delivered via a water circuit to a central heating system. The side parts 31, 32 are preferably made of sheet metal, but instead of sheet metal use may also be made of other materials, such as stone slabs, wood or plastic panels or panels made from yet other materials. These are then provided with hooks 33 on one side, so that they can be hooked onto corresponding eyes or slots on the lower part 20 of the stove. The front pane 29 of the burning chamber 19 is made from heat-resistant glass and can also be hooked onto the upper part 21 of the stove by means of hooks 33.

Figure 9:
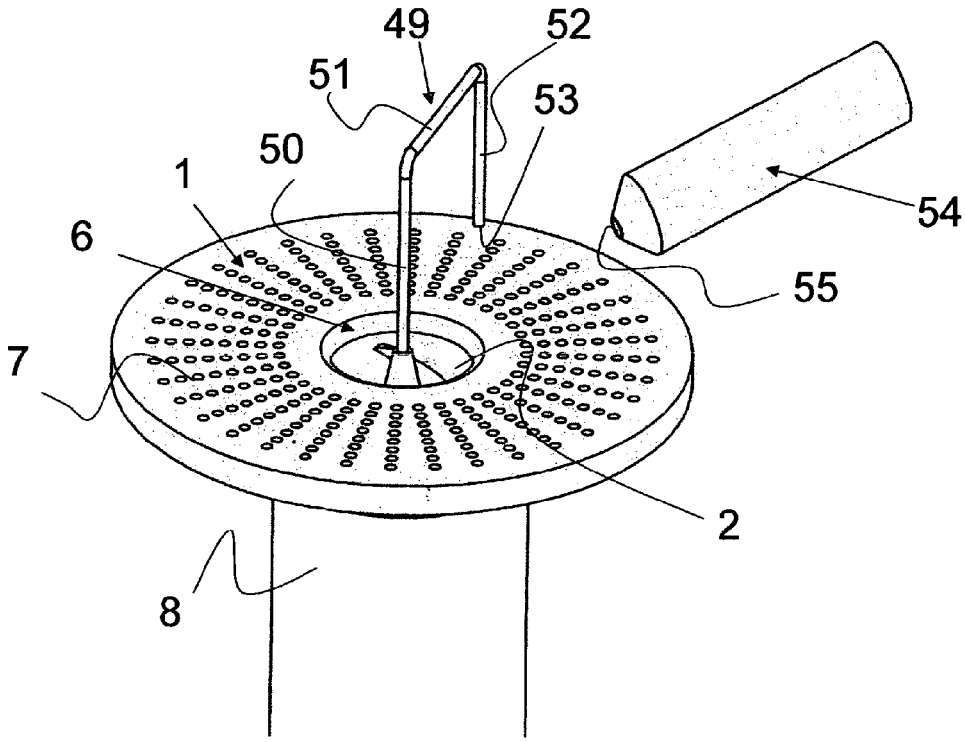
FIG. 9 shows a special detail of the fuel feed device in a prospective illustration.

FIG. 9 shows a special detail of the fuel feed device. Often the ash clumps together to form a lump and is then unevenly distributed on the grate. If the stove is equipped with an ignition element for automatic ignition of the fuel, a build-up of ash in front of the ignition element may take place, which impairs or prevents the function thereof. Larger clumps of ash arise, which soon use up the volume in the ash catcher. The feed device shown in FIG. 9 eliminates these problems by constantly breaking up the lumps of ash during operation and ensuring an even distribution of the ash on the grate, so that a build-up of ash in front of an installed ignition element is prevented. To this end, use is made of a steel bracket 49 which extends further upwards from the upper end of the conveyor screw spindle and thus forms firstly a portion 50 running axially relative to the conveyor screw and then, via an arch or a middle portion 51 running radially outwards here, leads into an outer portion 52 parallel to the axial portion 50. The lower end 53 of this outer portion 52 ends just above the grate surface, ideally approx. 8 mm above the latter. Depending on the size of the grate and the nature of the pellets, the distance may vary between 4 mm and 12 mm. When the conveyor screw rotates, for example at a speed of less than 1 rpm, this outer bracket portion 52 travels with its lower end over the grate and through the ash lying thereon. As a result, the lump of ash is ploughed through and crumbled as it were, so that a fine, homogeneous layer of ash remains on the grate. By virtue of the fuel that is pushed away from the middle of the grate, said ash is gradually pushed evenly around the outer edge of the grate and drops downwards into the ash container. Because the ash is very fine and homogeneous as a result of being ploughed through, there is overall less volume in the ash collector. An ignition element 54 is arranged in a manner inclined relative to the grate at an acute angle and at the periphery thereof. The tip 55 of the ignition element 54 constantly remains free due to the movement of the steel bracket 49 and there is no threat of blockage or accumulation of the ash in front of the tip 55 of the ignition element 54 and thus no impairment of the function thereof.

Figure 10:
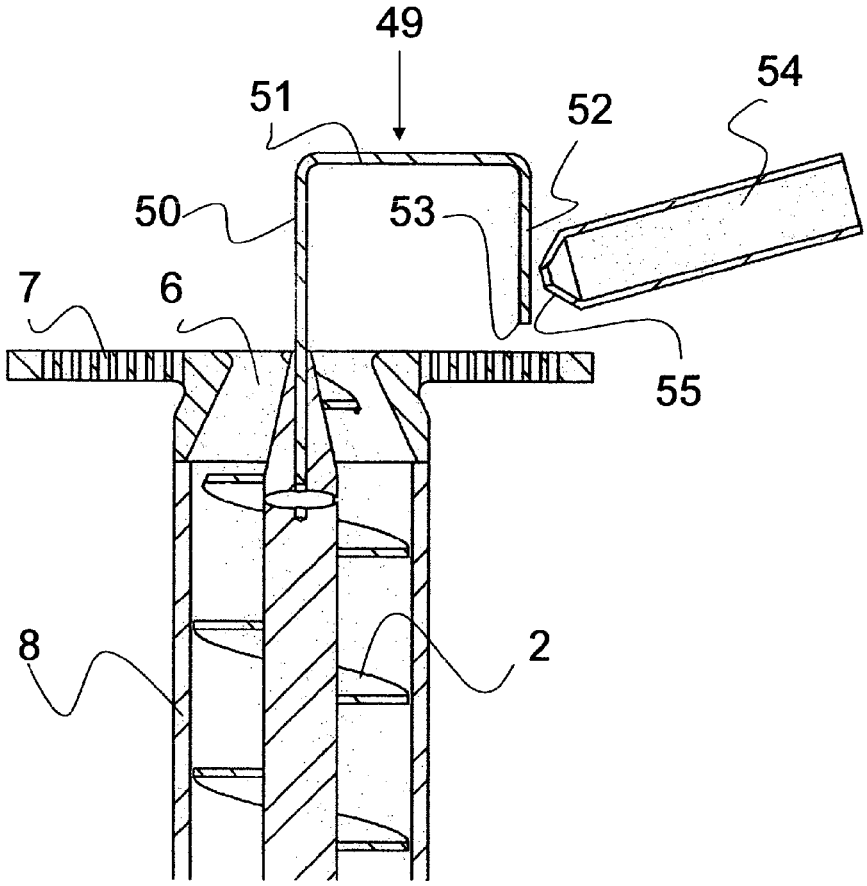
FIG. 10 is a cross-sectional view of the feed device shown in FIG. 9 additionally with the steel bracket shown in longitudinal section.

FIG. 10 shows this fuel feed device with the steel bracket 49 in longitudinal section. In this diagram, it can be seen that the outer portion 52 of the bracket 49 is located above the outer third of the radius of the grate 1 and its end is located above the grate surface, specifically approx. 8 mm above the grate surface. The tip 55 of the ignition element 54 is located close to the outer portion 52 of the bracket 49 moving past, and this region is therefore regularly or in cycles kept free of ash.

The fuel feed device for such wood stoves for power outputs of less than 1 kW is fitted with an electric motor which drives the screw 2 via a reduction gear unit. Depending on the voltage-dependent actuation of the electric motor, the speed of revolution of the conveyor screw 2 can be adjusted from 0.5 to 2 revolutions per minute, and hence the feed quantity of fuel per unit time and thus the heating power output can be controlled. Overall, the steel bracket on this fuel feed device offers the advantage that the ash is evenly distributed on the grate 1, the ash quality is finer and thus less volume is produced, and the ash drops evenly downwards from the outer edge of the grate. Furthermore, a build-up of ash in front of the ignition element is reliably prevented, and this ensures that the stove can be operated for a long period of time without any maintenance. The ash ultimately falls evenly over the outer edge of the grate and the ash quality is generally finer and firmer, so that less volume is produced.

The invention claimed is:

1. Wood pellet stove comprising a feed device for automatically adding wood pellets from a pellet hopper belonging to the stove, characterised in that the pellet hopper with the feed device and a grate are accommodated in a stationary lower part (20), which does not become hot during operation, and the burning chamber (19) is accommodated in an upper stove part (21), wherein the upper stove part (21) is mounted on the lower stove part (20) by means of a turntable (22) so that it can swivel relative to the lower, stationary stove part (20).

2. Wood pellet stove according to claim 1, characterised in that the turntable (22) between the lower stove part (20) and the upper stove part (21) has a central hole (24) for receiving the grate (1) and consists of a bottom disc (23), an intermediate disc (26) having holes (26) and balls (27) which are trapped therein and rest on the bottom disc (23), and a top disc (28) which rests on the balls (27) and supports the upper part (21).

3. Wood pellet stove according to claim 1, characterised in that the turntable (22) has two curved elongate holes (42, 43), each having a constant radius, which are intended for the passage of the flue gas and of the water pipes from the sheet metal body of the burning chamber in the upper stove part (21) into the lower part (20), and an elongate hole (43) for the supply of fresh air which leads from the lower stove part (20) into the burning space.

4. Wood pellet stove according to claim 1, characterised in that the lining of the lower stove part (20) and upper stove part (21) consists of plug-in, push-in or hook-on parts (29-32), so that the stove lining can be installed and dismantled or replaced without the need for tools.

5. Wood pellet stove according to claim 4, characterised in that the plug-in or hook-on parts (29-32) are steel panels, stone slabs, wood panels, fibre cement panels or plastic panels.

6. Wood pellet stove according to claim 1, characterised in that the lower stove part (20), which does not become hot, includes on its rear side a bezel (39) for gap-free connection between the rear side of the lower stove part (20) and a wall (41) running behind the latter.

7. Wood pellet stove according to claim 6, characterised in that the bezel (39) forms a sheet metal strip which is bent into a U-shape, so that the bezel (39) can be placed from above onto the rear side of the lower stove part (20), which does not become hot.

8. Wood pellet stove according to claim 1, characterised in that the burning chamber of the upper stove part is equipped with a sheet metal hollow body (41).

9. Wood pellet stove according to claim 1, characterised in that a conveyor screw having a spindle the spindle of the conveyor screw (2) runs out at the top into a steel bracket (49) which protrudes beyond a grate surface, and the end (52) of which on an outer portion (51) is directed downwards towards the grate (1) and ends in the outer third of the radius of the grate (1) at a distance from the grate surface.

10. Fuel feed device for granular fuel for a stove according to claim 9, characterised in that the steel bracket (49) has a portion (50) which is axial to the conveyor screw (2) as well as a downwardly projecting outer portion (51) which is parallel thereto and which ends at a distance of 5 mm to 12 mm from the grate surface.

11. Fuel feed device for granular fuel for a stove according to claim 9, characterised in that the circular grate (1) has an external diameter of 150 mm to 170 mm and the steel bracket (49) has a portion (50) which is axial to the conveyor screw (2) as well as a downwardly projecting portion (51) which is parallel thereto and which ends at a distance of 6 mm to 12 mm from the grate surface, said latter portion being spaced apart from the axial portion (50) by 55 mm to 65 mm.

12. Fuel feed device for granular fuel for a stove according to claim 9, characterised in that an ignition element (53) is arranged above the grate (1) in a manner inclined towards the grate (1), wherein the front end (54) of said ignition element ends in front of the outer portion (51) of the steel bracket (49).

* * * * *